US005584759A

United States Patent [19]

Fabrizi

[11] Patent Number: 5,584,759

[45] Date of Patent: Dec. 17, 1996

[54] PAINT SPRAY BOOTH

[75] Inventor: Giancarlo Fabrizi, Arezzo, Italy

[73] Assignee: Nova Verta International S.p.A., Arezzo, Italy

[21] Appl. No.: 500,064

[22] Filed: Jul. 10, 1995

[51] Int. Cl.[6] ..... B05B 15/12

[52] U.S. Cl. ..... 454/52; 118/326

[58] Field of Search ..... 454/50, 51, 52, 454/53, 54, 55; 118/326, DIG. 7

[56] References Cited

U.S. PATENT DOCUMENTS 5,040,482 8/1991 McGuire et al. ..... 118/326

FOREIGN PATENT DOCUMENTS 0006017 12/1979 European Pat. Off. ..... 118/326

2726155 12/1978 Germany ..... 118/326

*Primary Examiner*—Harold Joyce

*Attorney, Agent, or Firm*—Young & Thompson

[57] ABSTRACT

A spray paint booth having an internal base formed by two parts of which one is a fixed perimetral walk way (2) and the other one is a mobile central base (3) that holds the vehicle and/or other elements that require painting, a lifting mechanism is placed at the bottom of this mobile structure with which its level can be changed compared to the side walking structure around it.

10 Claims, 3 Drawing Sheets

PAINT SPRAY BOOTH

BACKGROUND OF THE INVENTION

1. Field of the invention

The invention relates to a spray paint booth, especially indicated for vehicle bodywork shop. Its structure has been conceived to hold vehicles, vehicle components and other mechanical equipment that require being spray painted.

2. Description of the Related Art

Existing spray paint booths for vehicles have a box-like structure. These booths are closed above by a ceiling through which purified air is normally pushed in, or however, filtered from suspended solid particles. The bottom of this structure is formed by a grating placed in a position raised from the floor, through which the air is pushed out towards recalling, suction openings, therefore towards filtering units which stop all solid particles from the paint and polluting vapours that are within the booth, before pushing out the intake air flow.

The base grating on which the tires of the vehicle to be painted will sit, is normally placed at a varying height—from 20 cm to 40–50 cm—from the floor on which the booth is placed and/or anchored.

Because of this, in order to introduce the vehicle inside the booth, in one case it is necessary to provide for slanted chutes on the outside of the booth to overcome the step on the entrance, while in another case it is necessary to use a ramp like structure, 1–2 meters long, on the initial part of the spray paint booth in order to allow the vehicle's access to the booth and therefore its preparation for the painting process.

All this entails big inconveniences when the vehicle to be painted is not equipped with an engine or if its engine is not functioning. In such cases to push the vehicle inside the booth requires the action of various people at the same time. This can be quite a problem in small shops where one or two people work. They are forced to ask for outside help to push the vehicle into the booth when it is ready to be painted.

Another disadvantage of the existing booths is in having a flat structured grating base within the cabin itself—not including the option ramp. This is why it becomes difficult for short-sized workers to spray paint the vehicle on the upper part or roof of the vehicle, while tall workers will find it difficult to spray paint the lower parts of the vehicle as for example the sides and lower parts of the doors.

Therefore, spray painting inside the existing booths is difficult and can turn out faulty, often requiring further interventions as touch-ups on the top and lower parts that did not turn out well painted, which means increasing labour time and therefore painting costs.

SUMMARY OF THE INVENTION

The aim of this invention is to eliminate all the inconveniences of previous techniques and to build a painting booth, particularly for spray painting, such that, only one person is needed to easily push the vehicle within the booth, whether it has an operating engine or not.

Another aim is to build a booth having a structure that makes it easy to spray paint the roof and all upper sides of the vehicle and also its lower parts, both for tall or short-sized workers, without requiring the aid of stools for elevation and sleds on which the worker can lie on, or other accessories that can help find a position to simplify his/her work and therefore obtain an even painting job. Therefore a booth having a structure that will simplify painting also for those workers that operate alone or in small groups, a booth that allows reduction in the time required for painting, and that gives the worker an ideal visualization of his/her work from within the booth, in order to eventually eliminate any touch up on badly painted spots in areas that were difficult to paint due to the position which made it difficult to carry out.

This invention, which helps to overcome those problems that are specific to existing booths and also to obtain the above mentioned advantages, consists of a spray paint booth having an inside base formed by two parts, one of which is perimetral and consists in a fixed walkway structure and one central mobile structure—which holds the vehicle and other elements and/or equipment that require painting—it is equipped on its lower part with an elevating mechanism through which its level is changed compared to the fixed perimetral walkway.

This booth has a quite convenient structure—due to the mobile base—since the mobile part is level with the floor when the vehicle is pushed into the booth to be painted. This operation can be easily carried out by a single person even if the vehicle's engine is not operating. During the painting phase, the mobile part of the base is placed at a lower level compared to the fixed walkway base placed all along the inner sides of the spray paint booth, this will facilitate the painter in completing the upper part of the vehicle, in the same way, the mobile base is brought to a higher level than the fixed walkway base when the lower parts of the vehicle require painting. With this system the painting of equipment is simplified independently from: how tall or short the worker may be, from the parts to be painted, from the structure and shape of the vehicle that requires painting or of any other parts and/or equipment or structures that must be painted.

BRIEF DESCRIPTION OF THE DRAWINGS

The invention is described in both its structure and function herebelow, with reference to the drawings, where.

Figure 1:
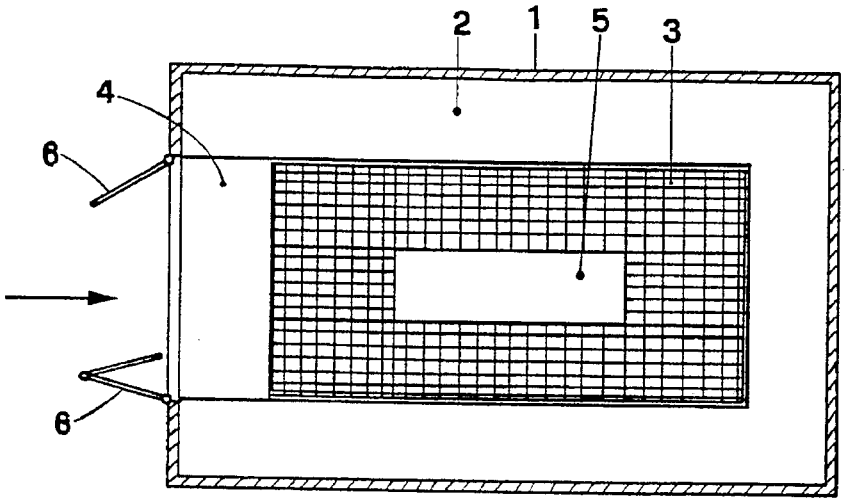
FIG. 1 is a schematic, overhead design view of the inside of the booth.

It must be made clear, however, that the drawings and description of their relative parts serve only to illustrate the subject of this invention and are by no means intended to restrict it.

DETAILED DESCRIPTION OF THE PREFERRED EMBODIMENTS

In the enclosed figures, 1 indicates the box-like structure of the spray paint booth, 2 indicates the fixed perimetral walkway within it, on which the workers move when painting, 3 is the central mobile base with grating structure, not including the central part 5, 4 indicates the entrance base, 20 is the filter placed on the inner sides of the perimetral walkway 2 through which the air inside the booth is pushed out, 7 is the filtering ceiling through which air is pumped into the booth, 8 are the mobile doors that close the entrance to the booth. 9 shows the lifting mechanism that acts on mobile central base 3, 10 is the fluid-mechanics jack that operates the articulated joint of the lifting mechanism 9 and causes the rotations which enable the elevation and lowering of the mobile central base 3, while 14 indicates the frame to which the lifting mechanism 9 and the fluid-mechanics jack 10 are coupled, enclosing them within its structure when the mobile central base 3 is on "floor level".

This spray paint booth foresees as its main characteristic the base structure of the booth itself.

Whereas other parts of this structure, such as the shape of the box-like structure, the electrical system, the fluid-mechanic system and other components that are necessary to complete the booth, may have different shapes and follow different techniques according to existing building and technical systems.

The base structure of this invention includes a combination of: a fixed perimetral walkway 2, where the worker/workers move on while painting, a mobile central base 3 whose height is adjustable, on which the vehicle is placed, and which is moved vertically during the painting process in order to change its position in height with respect to the workers, and finally the lifting mechanisms, controlled by the worker(s) that are used to move the vehicle or other equipment that requires painting, to be moved vertically until it reaches the level that is considered adequate by the worker(s).

The three above mentioned components together make it possible for the spray paint booth, subject of our invention, to overcome technical problems that are specific to all existing spray paint booths.

The invention therefore consists in:

A fixed perimetral walkway 2, placed along the inner sides of the booth 1 and normally also along the front which faces the side with the entrance door, this fixed perimetral walkway is placed at about 20–30 centimeters minimum from the floor on which the booth is standing or has been anchored, but normally it is positioned at 50 centimeters from the "floor level";

A mobile central base 3 that can have various levels starting as low as "floor level", in which its upper surface is only a few centimeters above the floor, all the way to a few tens of centimeters above the fixed perimetral walkway 2;

A mobile entrance base 4 which, independently from the mobile central base which holds the vehicle, is on the same level as the mobile central base 3 when it is on "floor level", therefore allowing the access or exit of the vehicle or any other element or structure that requires painting, or it can also be on upper levels such as being level with the fixed perimetral walkway 2 when the booth is operative, meaning during the painting process, so that the workers can easily move all around the vehicle or other equipment that requires painting, therefore walking on a flat base, avoiding possibilities of tripping and/or falling.

A lifting mechanism 9–10 by means of which the mobile central base 3 is moved, allowing changes in its height, to bring the vehicle or other equipment that requires painting at the appropriate height from "floor level".

The treading surface of the fixed perimetral walkway 2 is fixed and works also as cover to the upper part of the conduit within which the air inside the booth is pushed through a grided surface. The walkway houses the filter 20 which traps all solid particles suspended in the air. The walkway encloses/delimits the space inside which mobile central base 3 moves, from "floor level" to the same level as the treading surface of the fixed perimetral walkway 2 itself and even further on to a higher level.

Figure 2:
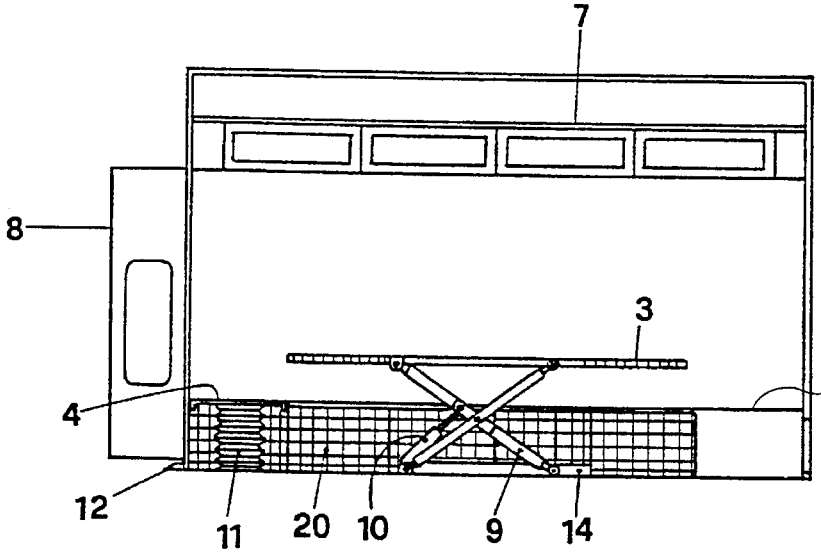
FIG. 2 is the side view of the cross section of the booth with a median vertical plane, in which the mobile part of the base is shown on a higher level compared to the fixed perimetral walkway base.
Figure 3:
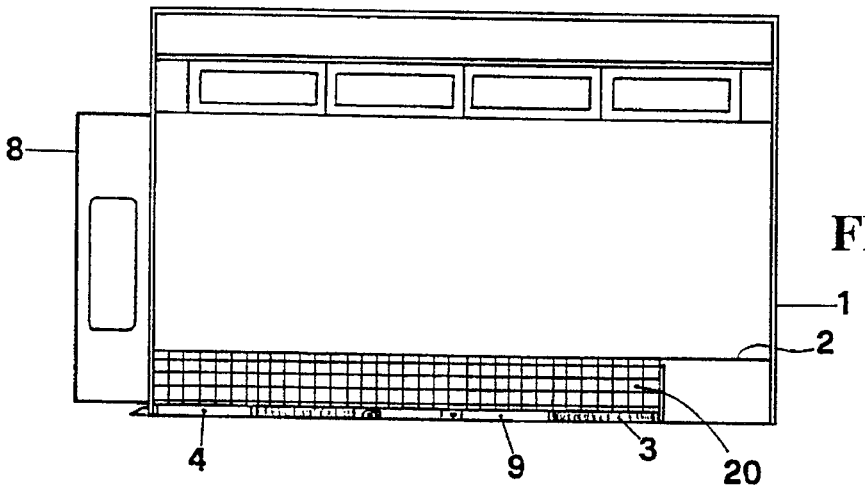
FIG. 3 is the side view of the booth, as in FIG. 2, however in this case the mobile part of the base is shown flat on floor level, except for a few centimeters representing its thickness.
Figure 4:
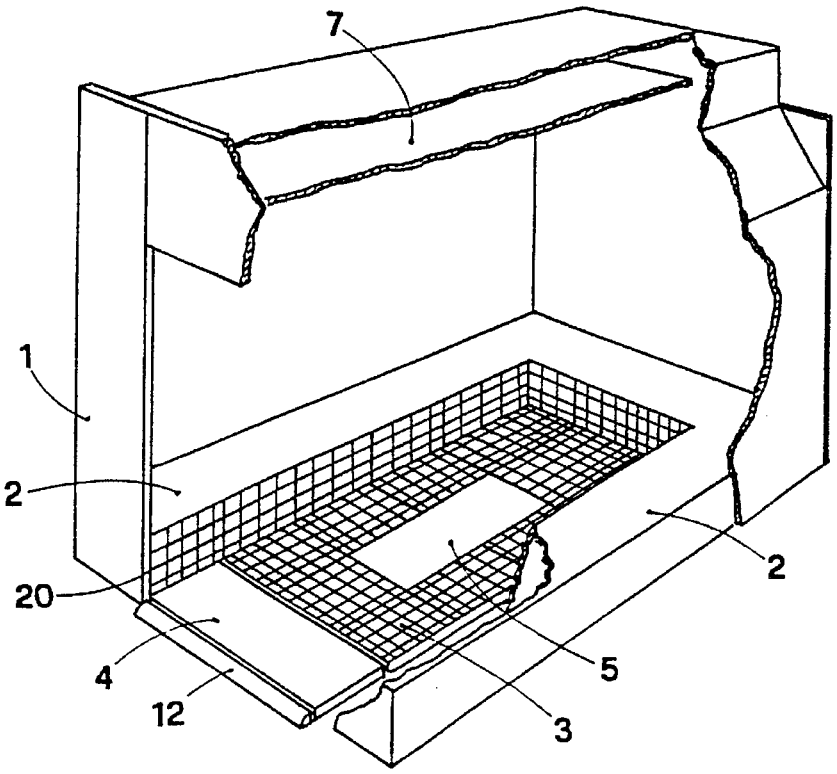
FIG. 4 shows a perspective view of the box-like structure of the booth, which has been partially sectioned to highlight the inside, in which the central mobile part of the base is shown on floor level.
Figure 5:
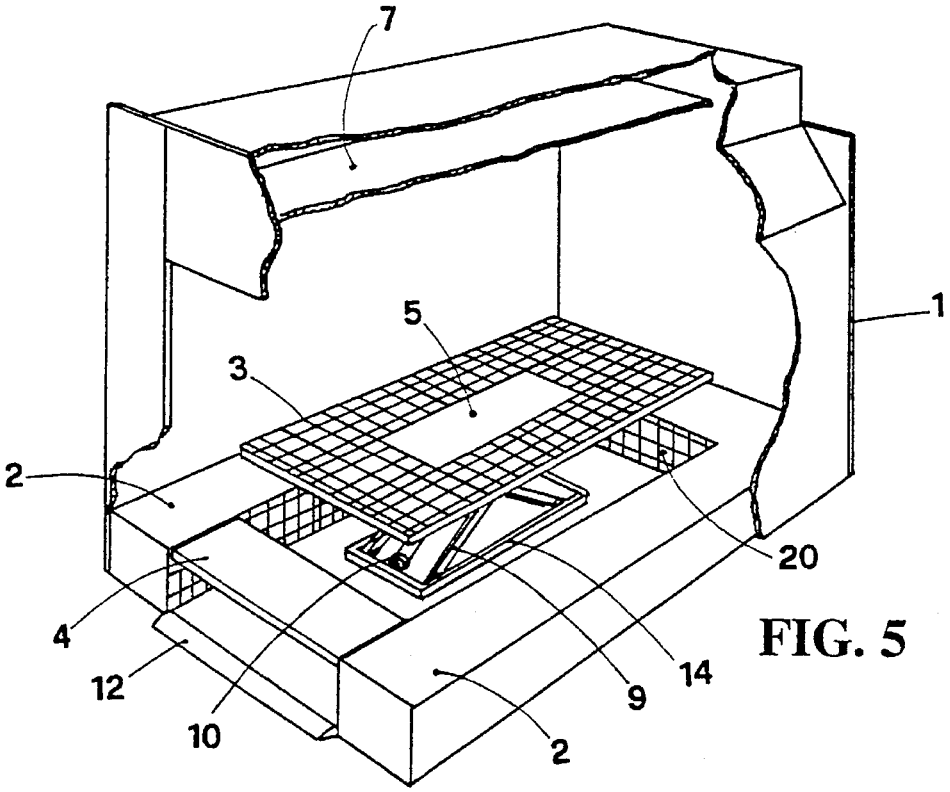
FIG. 5 is the perspective view of the booth structure as in FIG. 4, in which the central mobile part of the base is shown in an elevated position.
Figure 6:
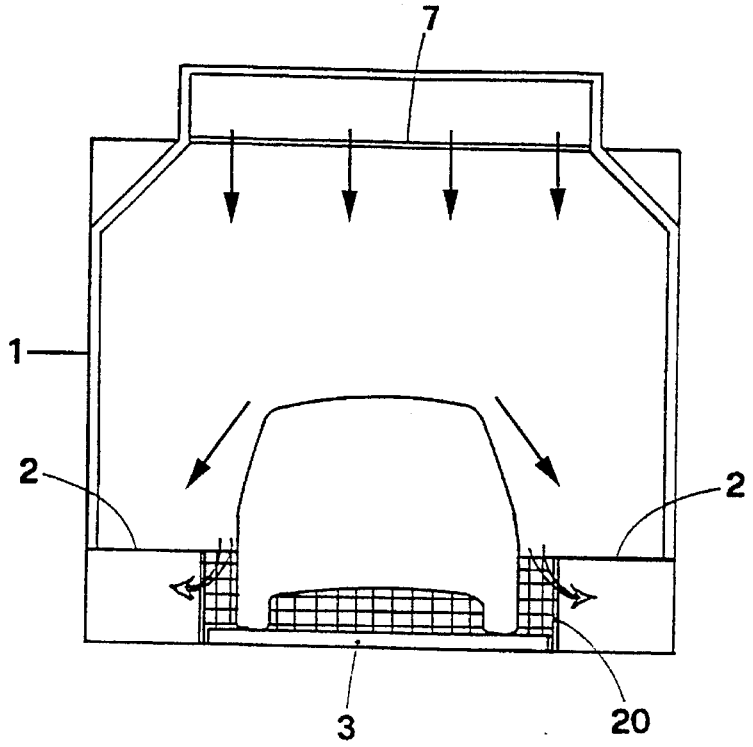
FIGS. 6 and 7 are a schematic representation of the front view of the inside of the booth with a vehicle in place, respectively on floor level and on an elevated position, the arrows indicate the flow of air inside the booth.
Figure 7:
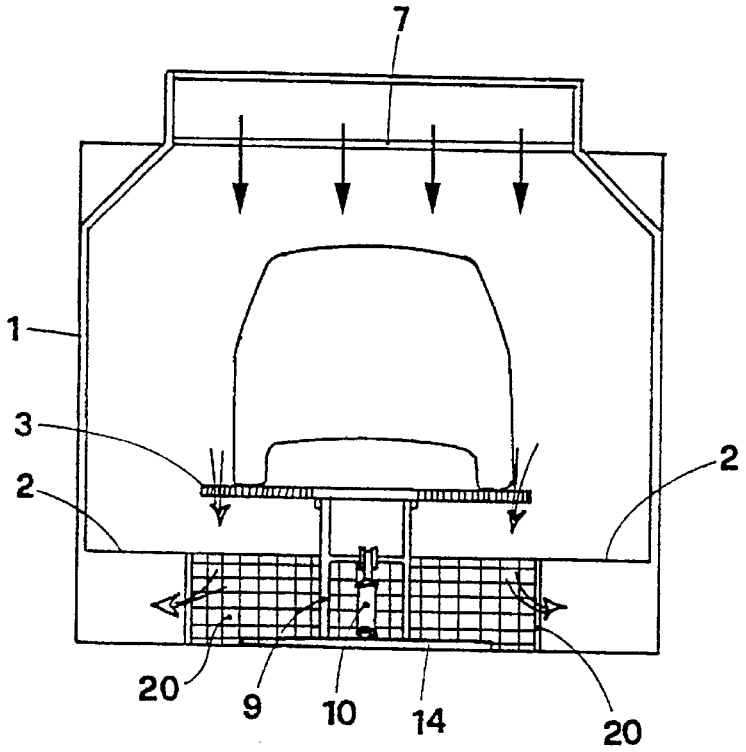

The mobile entrance base 4 could also move autonomously and independently from the mobile central base 3. In the example of FIG. 2, 11 is a compressed air elevating unit (bellows-like) through which the mobile central base is lifted from "floor level" to the level of the fixed perimetral walkway 2. It can however be controlled to change its level according to needs. This mobile entrance base can also be removable, it can be placed manually either on "floor level", when the vehicle must enter or exit the booth, or on higher levels, by using specific protruding teeth which make it usable as a shelf, when the spray paint booth is activated. The mobile central base 3, on which the object to be painted is placed, is made with ample grided surfaces, this facilitates the movement of air flows from up to down, so that all the surfaces of the vehicle, or other piece of equipment that are being painted, are involved during the drying process. The figures show that the central part 5 of mobile central base 3 is not a grate-like structure. The lower side of central part 5 is equipped with guides and hinges for the lifting mechanism, through which the mobile central base 3 can be moved vertically.

The base of the booth, subject of this invention, therefore includes a fluid-mechanics type elevating mechanism, which has been reproduced in the figures, with a fluid-mechanics jack housed beneath the same mobile central base 3.

It includes—at least in the preferred structure represented in the figures—a lifting mechanism 9 formed by couples of levers hinged to each other as diagonals of a parallelogram these levers are moved by the fluid-mechanics jack 10 to change their orientation and therefore the level of the mobile central base 3 held by the articulation itself.

The lifting mechanism 9 is anchored to a frame 14 in which it is housed when the mobile central base 3 is on "floor level", without requiring the digging of a hole or space beneath the floor on which the spray paint booth is placed. This allows the subject of this invention to be installed also on any floors of tall buildings.

A base of this type includes a central mobile base 3 and an entrance base 4, which is only a few centimeters above the "floor level" when in a resting position, this means that even a vehicle without a functioning engine can be pushed in by a single worker, without any external help. Once the vehicle is in, the mobile central base 3 can be lifted to the level required by the worker, which part of the vehicle needs painting. Therefore the level of the mobile central base can be changed during the painting process according to need, by acting on a control pannel that is normally placed inside the booth.

I claim:

1. A spray paint booth comprising:

a structure for housing vehicles, vehicle components, and other articles that need to be spray painted;

an inside base having a fixed perimetral walkway;

a mobile central base for holding the article to be painted; and a lifting mechanism for changing the level of the mobile central base with respect to the fixed perimetral walkway.

2. The spray paint booth according to claim 1, wherein the structure is anchored on a floor, and includes a front part having an entrance door, and inner sides, the fixed perimetral walkway is positioned along the inner sides of the structure and along its front part where the entrance door is located, and the level of the fixed perimetral walkway is at least 20 centimeters from the floor.

3. The spray paint booth according to claim 2, wherein the fixed perimetral walkway has a treading surface which functions as a cover for an upper part of a conduit within which air pushed into the booth, flows out during painting.

4. The spray paint booth according to claim 3, wherein the fixed perimetral walkway delimits a space inside which the mobile central base moves from the floor level to a level at least equal to that of the treading surface of the fixed perimetral walkway, said space having a grided surface which houses a filter.

5. The spray paint booth according to claim 2, further including a mobile entrance base positioned at floor level for allowing vehicles to enter and exit the booth, said mobile entrance base being positioned at a higher level flush with the fixed perimetral walkway during painting.

6. The spray paint booth according to claim 5, wherein the mobile entrance base is removable.

7. The spray paint booth according to claim 1, wherein the mobile central base has a wide grided surface that is moved vertically by the lifting mechanism.

8. The spray paint booth according to claim 1, wherein the lifting mechanism is positioned underneath the mobile central base.

9. The spray paint booth according to claim 1, wherein the lifting mechanism comprises an articulated joint formed by a couple of levers hinged to each other like diagonals of a parallelogram, said levers being moved by a fluid-mechanics jack to change their orientation, and therefore the level of the mobile central base.

10. The spray paint booth according to claim 2, further including an anchoring frame which houses the lifting mechanism of the mobile central base, when the mobile central base is at floor level.

* * * * *